US007089871B2

(12) United States Patent
Smith, Jr.

(10) Patent No.: US 7,089,871 B2
(45) Date of Patent: Aug. 15, 2006

(54) TIER SHEET

(75) Inventor: Edward E. Smith, Jr., Richmond, VA (US)

(73) Assignee: Covalence Specialty Materials Corp., Minneapolis, MN (US)

( * ) Notice: Subject to any disclaimer, the term of this patent is extended or adjusted under 35 U.S.C. 154(b) by 170 days.

(21) Appl. No.: 10/725,861

(22) Filed: Dec. 1, 2003

(65) Prior Publication Data

US 2005/0115472 A1 Jun. 2, 2005

(51) Int. Cl.
*B65D 19/38* (2006.01)

(52) U.S. Cl. ..... 108/53.1; 108/55.3; 108/51.11

(58) Field of Classification Search ..... 108/51.11, 108/57.29, 57.28, 901, 902, 53.1, 53.3, 53.5, 108/55.1, 55.3, 57.18; 206/386
See application file for complete search history.

(56) References Cited

U.S. PATENT DOCUMENTS

| | | | | | |
|---|---|---|---|---|---|
| 1,953,303 | A | * | 4/1934 | Kohlmann | 108/55.3 |
| 2,455,197 | A | * | 11/1948 | Sullivan | 108/52.1 |
| 2,928,200 | A | | 3/1960 | Shiels | |
| 3,591,032 | A | * | 7/1971 | Baxter | 108/53.1 |
| RE29,192 | E | * | 4/1977 | Anderson et al. | 108/51.3 |
| 4,507,348 | A | * | 3/1985 | Nagata et al. | 108/57.25 |
| 4,638,941 | A | | 1/1987 | Watson | |
| 4,688,684 | A | | 8/1987 | Young et al. | |
| 4,750,623 | A | | 6/1988 | Flum | |
| 5,016,761 | A | | 5/1991 | Stoddard et al. | |
| 5,062,370 | A | * | 11/1991 | Etlinger | 108/51.3 |
| 5,246,113 | A | | 9/1993 | Schuster | |
| 5,360,112 | A | * | 11/1994 | Beauchamp | 108/55.3 |
| 5,383,408 | A | | 1/1995 | Searcy | |
| 5,525,030 | A | | 6/1996 | Buchman | |
| D415,482 | S | * | 10/1999 | Jolson | D14/447 |
| 6,530,476 | B1 | * | 3/2003 | Overholt | 206/386 |
| 6,541,097 | B1 | * | 4/2003 | Lynch et al. | 108/57.29 |
| D476,529 | S | | 7/2003 | McMullin | |

FOREIGN PATENT DOCUMENTS

| | | |
|---|---|---|
| AT | 359 367 | 10/1980 |
| DE | 8305297 | 5/1983 |
| EP | 1 291 306 | 12/2003 |
| FR | 2 679 529 | 1/1993 |
| GB | 1 568 936 | 6/1980 |

OTHER PUBLICATIONS

Copy of International Serarch Report dated May 20, 2005 from corresponding PCT application, PCT/IB2004/004402.

* cited by examiner

*Primary Examiner*—Jose V. Chen
(74) *Attorney, Agent, or Firm*—Moser IP Law Group

(57) ABSTRACT

A tier sheet for supporting a plurality of containers disposed in rows on the tier sheet and for supporting and separating a plurality of tiers of the containers to provide a tiered stack of the containers. Projections at the edge portions of the tier sheet extend from and above an upper surface and extend from and below a lower surface of the tier sheet sufficiently to impede lateral movement of an outside container disposed at an outside row from displacing the outside container from the stack.

13 Claims, 5 Drawing Sheets

TIER SHEET

The present disclosure relates to tier sheets for supporting rows of containers disposed in a plurality of tiers to provide a tiered stack of containers. More particularly, the present disclosure relates to configurations of the tier sheets to impede displacement of an outside container from such a stack of containers.

BACKGROUND OF THE DISCLOSURE

It is conventional in the art to stack containers in tiers for shipping, handling and display. Tiers of the containers are separated by conventional tier sheets which support and separate a plurality of tiers of the containers forming a stack of the containers. The stack of containers is usually held together by conventional strapping, e.g. metal or plastic strapping, and/or conventional plastic wrap.

It is also conventional that a stack of containers be placed in a retail outlet and that customers remove containers from that stack for purchase. This is typically done, for example, with canned goods or soft drink bottles in food stores, particularly soft drink bottles of larger sizes, e.g. 16 oz. or 18 oz. or one liter or two liter sizes. With such display, as the containers are removed from the stack, the tier sheets are simply removed from the stack to present a new tier of containers for purchase.

Such tiered stacks of containers are also assembled by manufacturers of the containers for shipping empty containers to others for placing contents in the containers. In this case, usually, the containers do not have a closure. For example, the containers may be a bottle with a threaded mouth but no cap thereon, where the cap is placed on the bottle after filling.

Whether the tiered stack of containers is empty, e.g., assembled by the manufacturer of the container for shipment to others, or filled, e.g., by a manufacturer who fills the container and applies the closure, these stacks encounter fairly rough handling during in plant movement and long distance transit. Generally, the first tier of the stack is placed on a conventional pallet, and subsequent tiers of containers are separated by tier sheets, as noted above. The stacked pallet is configured to be moved on a conveyor or by a conventional forklift, during manufacture, filling or distribution. Such movement by a conveyor or forklift and the like cause considerable forces to be applied to the stack of containers, and it is very typical that during such handling, some of those containers in the tiered stack are displaced from the stack. Once the stack is wrapped with a plastic wrap and strapped with conventional strapping, the stack is fairly secure and few containers are displaced.

The displacement of containers from a stack, prior to strapping and wrapping the stack with plastic film is a particularly difficult problem to solve. Even with relatively gentle handling, e.g., with a forklift or with a conveyor line, it is not unusual for a number of containers to be displaced from the stack, and those containers must be hand inserted back into the stack, which is labor intensive and a discontinuity in the manufacturing process.

There have been several attempts in the art to mitigate this problem, and, basically, these attempts involve providing edges of the tier sheet in the form of a generally vertically disposed wall portion for impeding lateral movement of the containers in the stack. For example, U.S. Pat. No. 2,928,200 shows edge portions of a tier sheet being folded downwardly to restrain the tops of bottles, or other containers, in a lower tier. U.S. Pat. No. 4,638,941 shows edge portions of the tier sheet being folded into a wall portion which likewise functions to retain the containers in a tiered stack. However, these approaches are relatively expensive because they involve substantial modification and reconfiguration of the tier sheet. While these approaches are commercially used for some containers, the expense thereof makes them impractical for many other containers.

Accordingly, it would be of a substantial advantage to the art to provide a tier sheet, which can impede lateral movement of an outside container disposed at an outside row of a tiered stack of containers such as to prevent that container from being displaced from the stack during handling of the stack. Additionally, the tier sheet can be produced at a very low expense, making the tier sheet generally useful for all types of stacks of containers.

SUMMARY OF THE DISCLOSURE

The present disclosure is based on several primary and subsidiary discoveries. First of all, it was discovered that projections at edge portions of the tier sheet can be made to extend from and above an upper surface and extend from and below a lower surface of the tier sheet sufficiently to impede lateral movement of an outside container disposed at an outside row from displacing the outside container from the stack. As a subsidiary discovery, it was found that such projections could be easily placed in a conventional tier sheet, e.g., made of fiberboard, plastic, kraft or chip board, by a specially designed scoring tool.

As another primary discovery, it was found that when the projections extend from both the upper surface and the lower surface of the tier sheet, the tier sheets not only very effectively functioned to impede lateral movement of an outside container from the stack, but also allow the tier sheets to be used with either surface being the upper surface, i.e., the tier sheets are reversible. This is particularly important for fast assembly of stacks, since no particular orientation of the present tier sheet is required.

As a subsidiary discovery in this regard, it was found that by having a depression in a side or surface of the edge portion opposite from the projection, the depression can be utilized for further impeding lateral movement of containers from the stack.

As a subsidiary discovery in this regard, it was found that in such cases it is preferable that there be at least two projections from one surface of the tier sheet and at least one projection from the other surface of the tier sheet, with corresponding depressions on the opposite side or surface of the edge portion.

Thus, briefly stated, the present disclosure is in a tier sheet for supporting a plurality of containers disposed in rows or other configuration (e.g., diagonal, staggered, alternating, etc.) on the tier sheet and for supporting and separating a plurality of tiers of the containers to provide a tiered stack of the containers. The present disclosure involves an improvement in such tier sheets where projections are provided at edge portions of the tier sheet and the projections extend from and above an upper surface and extend from and below a lower surface of the tier sheet sufficiently to impede lateral movement of an outside container disposed at an outside row from displacing the outside container from the stack.

BRIEF DESCRIPTION OF THE DRAWINGS

The objects and features of the present disclosure, which are believed to be novel, are set forth with particularity in the appended claims. The present disclosure, both as to its organization and manner of operation, together with further objectives and advantages, may be best understood by reference to the following description, taken in connection with the accompanying drawings, as set forth below:

DESCRIPTION OF EMBODIMENTS

The exemplary embodiments of the tier sheets and methods of manufacture are disclosed and discussed in terms of production, manufacturing and transportation structures for use in supporting multiple rows of products including containers and the like. Reference will now be made in detail to the exemplary embodiments of the disclosure, which are illustrated in the accompanying figures.

Figure 1:
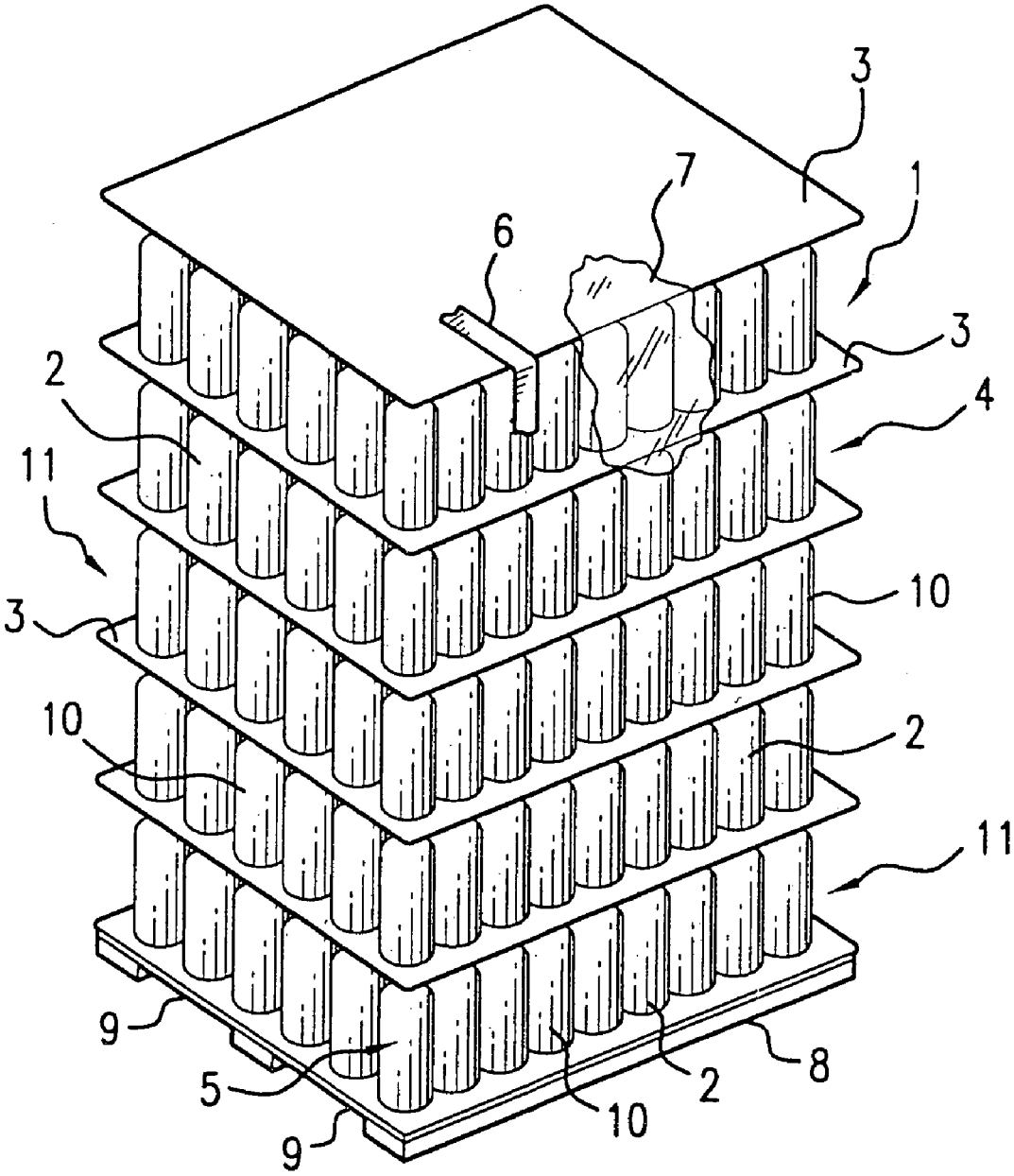
FIG. 1 (PRIOR ART)
FIG. 1 is an isometric view of a prior art tiered stack of containers arranged in a conventional manner.

As shown in FIG. 1, the present disclosure involves a stack, generally 1, of containers 2 separated by tier sheets 3. The stack contains a plurality of tiers, generally shown by reference numeral 4, with five tiers being shown in FIG. 1. It will be noted that the tier sheets 3 support a plurality of containers disposed in rows, generally 7 or more, on the tier sheets 3. The tier sheets 3 support and separate the plurality of tiers of the containers to provide the tiered stack 1 of containers for moving, shipping and display. The stack 1 may be held together by conventional strapping 6 (only a diagrammatic partial strap shown in FIG. 1), which may be made of any conventional strapping materials, such as metal, plastic, woven webs, and the like. Alternatively or in addition thereto, the stack may be held together by a plastic wrap 7 (only a partial portion of the wrap being shown in diagrammatic form in FIG. 1). The tiers 4 of containers 2 are supported by a conventional pallet 8 having openings 9 therein for receiving the forks of a forklift truck. As can be seen, the tier sheets 3 in FIG. 1 are entirely planar, which is very conventional in the art, although those tier sheets may have the folded end configurations of the prior art noted above. The containers may be any containers, such as bottles, cans, cartons, tubes and the like, either filled with a product or empty, so long as the containers are generally of about the same height, at least the containers in each tier being about the same height.

Figure 2:
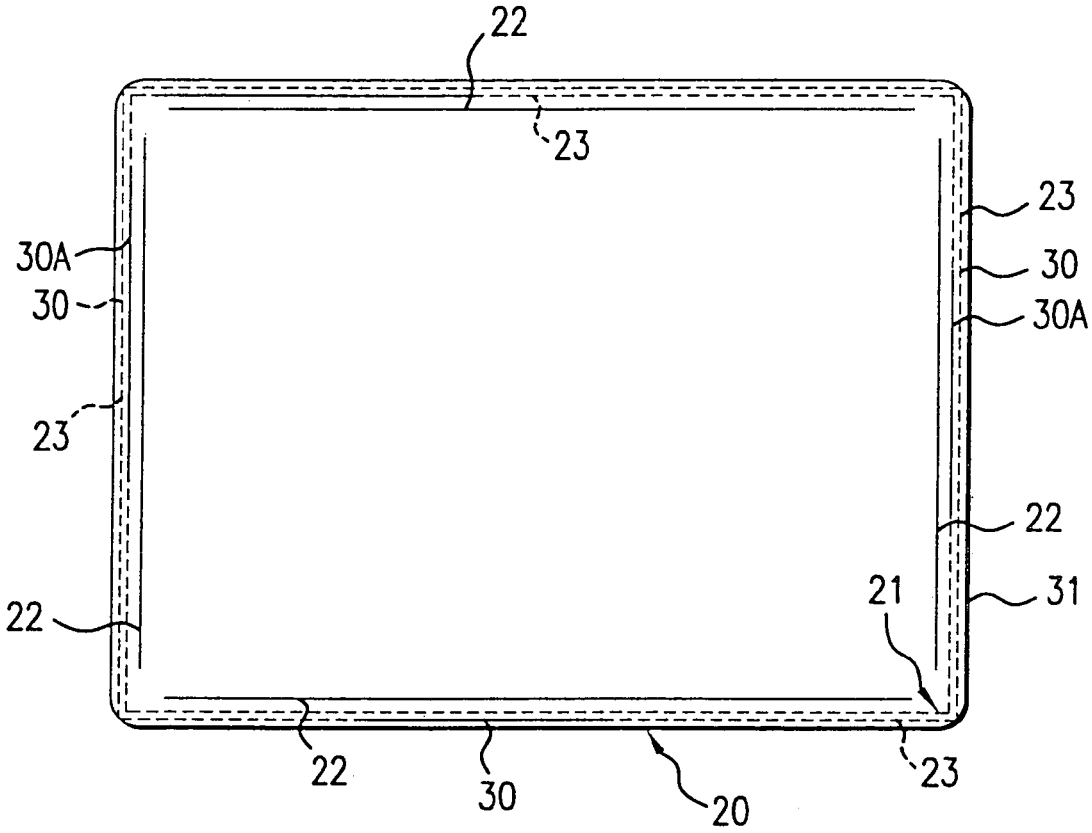
FIG. 2 is a top plan view of the tier sheet according to the present disclosure.
Figure 3:
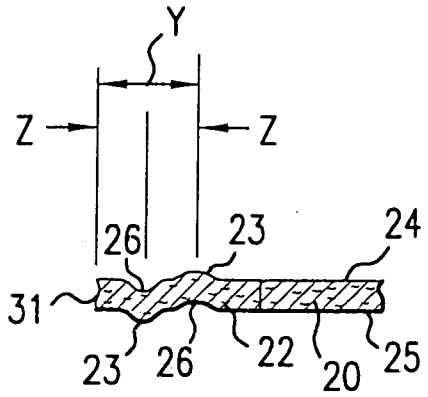
FIGS. 3 and 4 show embodiments of the projections and depressions disposed at an edge portion of the tier sheet of FIG. 2.
Figure 4:
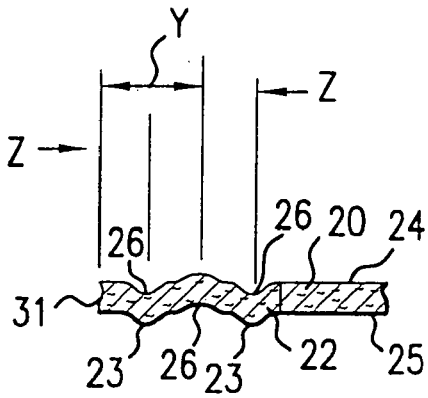

FIG. 2 is a top plan view of the present tier sheet 20 having generally rounded corners 21 and edge portions 22. In the edge portions 22 are projections 23. As best seen in FIGS. 3 and 4, projections 23 extend from and above an upper surface 24 and extend from and below a lower surface 25 of tier sheet 20. The upper 24 and lower 25 surfaces generally define planar sections of tier sheet 20. The projections 23 extend beyond the plane defined by the upper 24 and lower 25 surfaces. The projections 23 extend below and above the said surfaces sufficiently to impede lateral movement of an outside container 10 (see FIG. 1) disposed at an outside row, generally 11, from displacing the outside container 10 from the stack 1.

As indicated in FIG. 2, the projections extending from at least one surface may be discontinuous, as shown by the dotted lines 30 of FIG. 2, or they may be continuous, as shown by the solid lines 30A of FIG. 2. However, it is preferred that the projections be continuous, since this provides more secure retainment of the containers and is easier to construct the tier sheets, as disclosed in more detail below.

In an alternate embodiment of the present disclosure, it is contemplated that the tier sheet 20 include a general interior planar section (FIG. 2) surrounded by edge portions 22. The interior planar section is generally planar and devoid of projections 23 and depressions 26.

Figure 5:
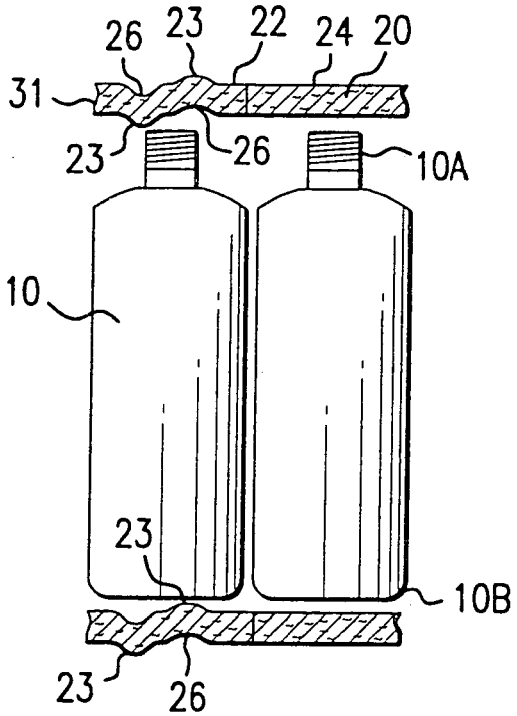
FIGS. 5, 5A and 6 show containers disposed on a tier sheet and separated above and below by tier sheets according to the present disclosure.

In an alternate embodiment, as shown in FIGS. 3 and 4, opposite a projection 23 is an opposite depression 26 in edge portion 22. As can be seen from FIGS. 5 and 6, the combinations of the projections and depression help to secure not only the tops 10A of containers 10 but the bottoms 10B of containers 10 in the outside row 11 (see FIG. 1) of the containers. This is particularly true when the bottom portion 27 (see FIG. 6) of a container has an indentation 28, which is very common in the art. It is also contemplated herein that the depressions 26 extend to a point within the width of the tier sheet 20 to form a trough or depression therein.

Figure 6:
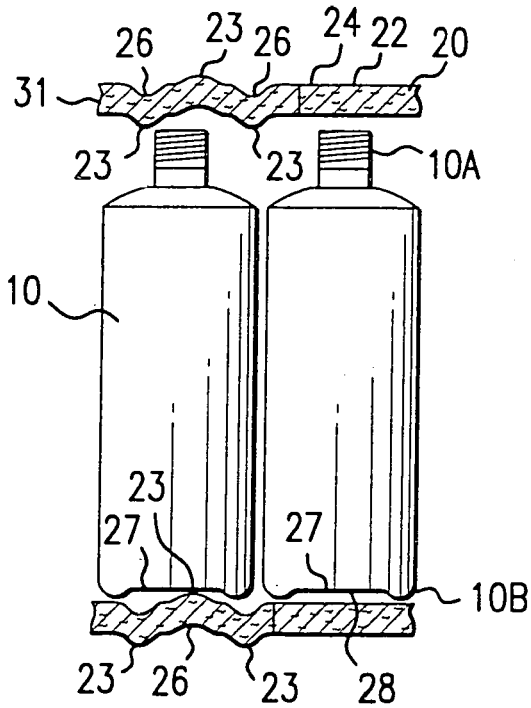

In an alternate embodiment, at least one edge portion 22 has at least two projections 23 (see FIG. 4) extending from one of the surfaces 24, 25 and the other of the surfaces 24, 25 has a corresponding number of depressions 26. This is particularly favorable for retaining bottles 10 which have an indentation 28, as shown in FIG. 6.

Figure 5A:
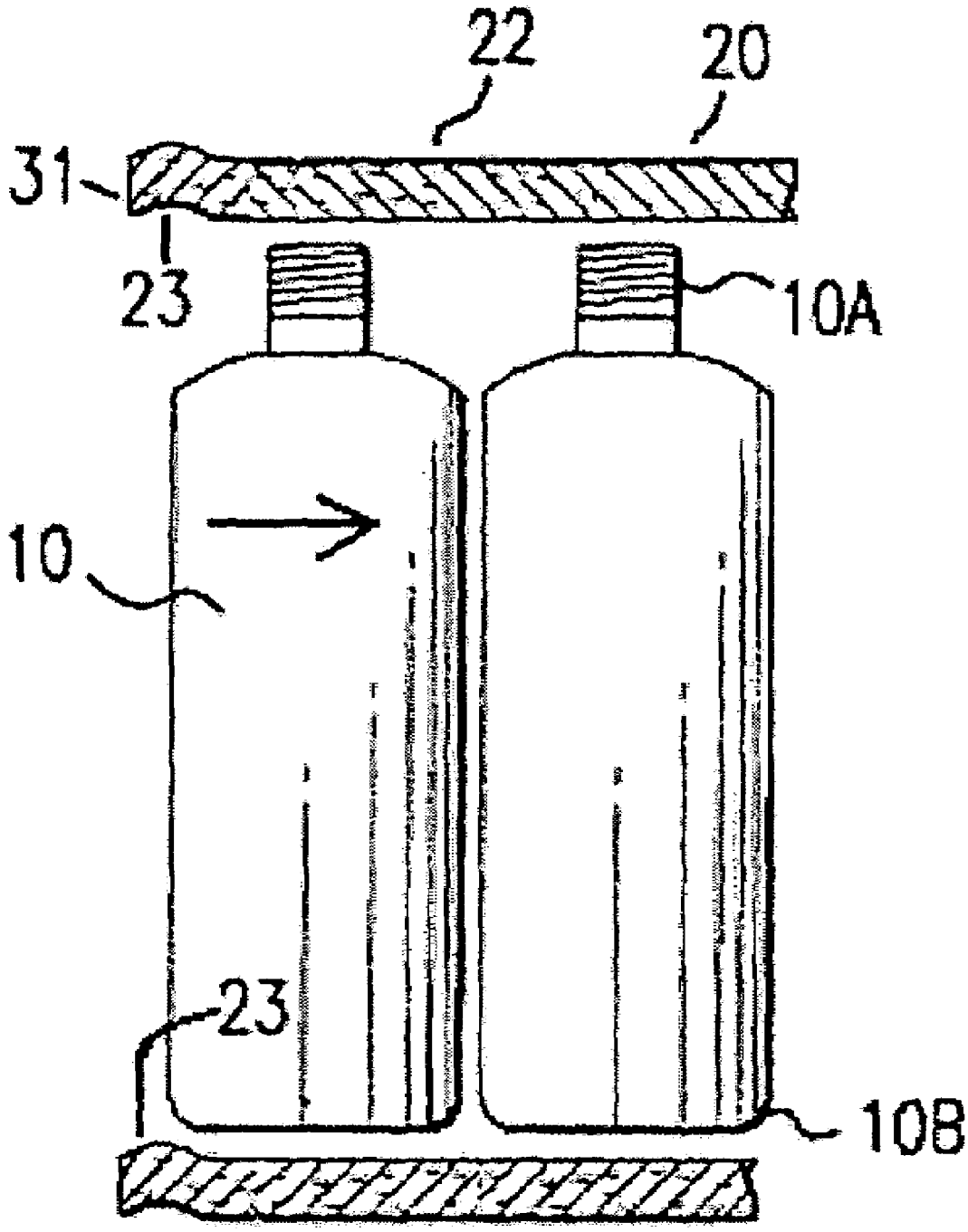

In an alternate embodiment, edge portions 22 may include, at an outer-most portion thereof (see FIG. 5A), projections 23. These outer-most spaced projections 23 aid in retaining the containers within the tier sheet confines. In addition, it has been shown that these outer-most projections 23 cause the containers to tip inwardly (as indicated by the arrow direction) toward the tier sheet interior section, which provides for a more secure grip of the containers. It is contemplated that the projections 23 can be used with or without corresponding depressions 26 and other projections 23 along edge portions 22.

In an alternate embodiment, the projections 23 and opposite depressions 26 are in the form of a score line, as shown by dashed and solid lines 30 and 30A in FIG. 2. The score line in the surfaces 24, 25 form the projections 23 and depressions 26.

The arrangement of the tier sheets 3, shown, especially, in FIGS. 3–6, has an outermost projection 23 nearest to outermost edge 31 in the lower surface 25. For some containers, it is advantageous that the outermost projection nearest the outermost edge be in the upper surface 24. This can be easily achieved simply by disposing (flipping) the tier sheets such that the lower surface 25 becomes the upper surface and the upper surface 24 becomes the lower surface. In other words, the present tier sheets are reversible in vertical orientation to accommodate a wide variety of containers. This makes the present tier sheets particularly useful.

Generally speaking, the edge portion 22 will have a width of at least 0.5 inch and up to one inch or even as much as two inches. However, the outermost projection will be less than that distance from the outermost edge 31 of the tier sheet. As shown in FIG. 3, the innermost projection and corresponding depression has a distance Y from the outermost edge 31 somewhat less than the total edge portion 22. That distance Y typically will be less than the two inches noted above and generally less than one inch. The outermost projection and corresponding depression will generally be centered within the distance Y, as shown by the distances Z in FIGS. 3 and 4. Where there are multiple projections and depressions, the distance Z between corresponding projections and depressions will be of a similar or same distance, as shown by distances Z in FIG. 4. It is contemplated herein that the above noted widths, edge, projection and depression dimensions may be placed in any configuration or placement as required by the particular tier sheet or proposed container requirements.

Thus, substantially all edge portions (with the exception of corners) have at least one continuous projection 23 in the form of a continuous score line, as shown by solid lines 30A in FIG. 2, extending from one of the surfaces 24, 25 and a corresponding number of opposite depressions 26 in a surface 24, 25 opposite the continuous projections. In an alternate embodiment, such projections extend from the surfaces at least 0.1 inch and the depressions extend into the opposite surface a like amount. However, the projections extend from the surface and the depressions extend into the surface at least 0.2 inch and up to 0.4 inch. As stated above, it is contemplated that the dimensions may be altered according to the contemplated usage requirements of the tier sheets.

The overall length and width of the tier sheets can vary widely, depending upon the intended purpose, but, generally speaking, the tier sheets have lateral dimensions of from 18 to 60 inches. The tier sheets can also vary considerably in thickness, but, generally speaking, are about 0.02 to 1.0 inch, especially 0.03 to 0.3 inch thick.

The tier sheets can be made of any desired material, but generally are made from fiberboard, plastic, kraft board and chip board. The materials, of course, must be capable of forming the projections and/or projections and depressions.

Since the tier sheets are often stored in warehouses, as are stacks of containers separated by the tier sheets, the tier sheet may contain a bactericide and/or an insecticide, e.g. impregnated into a kraft board tier sheet. Alternatively, the bactericide and/or insecticide may be coated on the tier sheet. Any of the usual bactericides and insecticides may be used for this purpose. With bactericides and insecticides associated, with the tier sheets, this allows reuse of the tier sheets without fear of bacterial or insect contamination.

Figure 7:
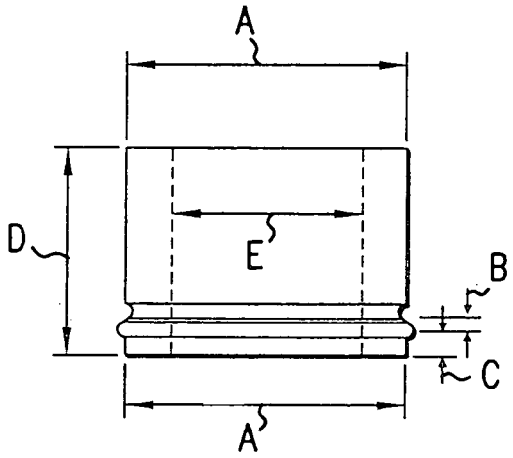
FIGS. 7 through 10 show an appropriate tool for producing the projections and depressions of the tier sheets according to the present disclosure.
Figure 9:
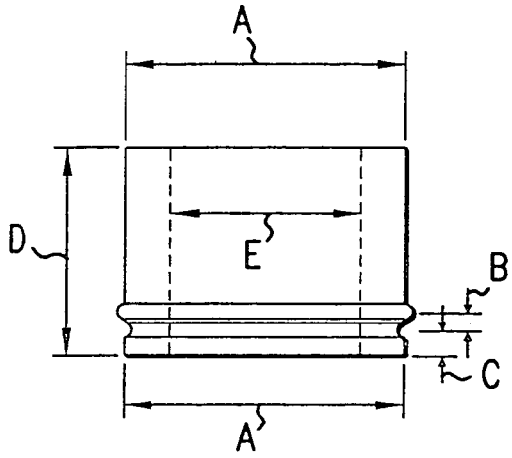

In connection with the embodiments of continuous score lines with both projections and depressions, FIGS. 7 through 10 show typical machine heads for producing such score lines. These machine heads are simply attached to a conventional rolling machine, and the edge portions of the tier sheets are passed between the machine heads to cause the projections and indentations in the edge portion of the tier sheet. FIG. 7 illustrates a top cylinder of the machine heads, and FIG. 9 illustrates a bottom cylinder of the machine heads. Typical dimensions of the bottom and top cylinders are: outside diameter A of about 5.25 inches, the distance between projections and depressions B of about ⅜ inch, and the distance between an outermost depression and the edge portion C of about 0.5 inch. The height of each cylinder D can typically be about 4.0 inches, and an internal bore E about 3.5 inches for fitting onto a typical machine.

Figure 8:
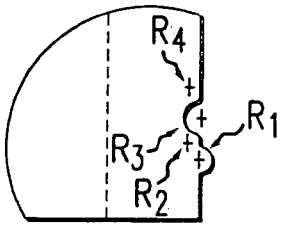
Figure 10:
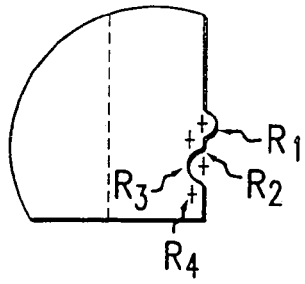

Appropriate radiuses for the cylinders are shown in FIGS. 8 and 10, respectively, where, typically, $R_1$ is ⅛ inch, $R_2$ is 1/16 inch, $R_3$ is 5/32 inch, and $R_4$ is 1/16 inch altrough other dimensions are contemplated.

By way of example, a plurality of tier sheets made of kraft board 0.08 inch thick and approximately 44 inches by 56 inches was scored along each edge with the machine heads shown in FIGS. 7 through 10 to produce continuous projections and depressions at the edge portion of the tier sheets. Stacks were made using these tier sheets and loaded with bottles similar to those shown in FIGS. 5 and 6 to form stacks having eight tiers in a stack. Some of the stacks were strapped with conventional web strapping and supported on a conventional pallet. Similar stacks were also made using conventional planar tier sheets and pallets. The pallets were handled in a commercial operation which ordinarily used conventional planar tier sheets. During processing through that facility with conventional planar tier sheets, an average of about five bottles fell out of the stacks prior to strapping, whereas, with the tier sheets of the present disclosure, an average of less than one bottle fell out of the stacks prior to strapping. During handling of the strapped stacks, the number of bottles that fell out of the stacks during normal handling in the facility using the tier sheets of the present disclosure was reduced by 85% from the number of bottles that fell out of the stacks using conventional planar tier sheets. These tests were conducted with both 16 oz. and 18 oz. bottles with both straight and swirled walls. Also, in similar tests, after removing shrink wrap with which the stacks were overwrapped, with conventional planar tier sheets, between 5 and 15 bottles fell out of the stacks prior to unloading, but with the present tier sheets, from 0 to 3 bottles fell out of the stacks during unloading, even with the usual bumps in the typical conveying system of the facility.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended hereto.

What is claimed is:

1. In a tier sheet for supporting a plurality of containers disposed in rows on the tier sheet and for supporting and separating a plurality of tiers of the containers to provide a tiered stack of the containers, said tier sheet having a perimeter, the improvement comprising:

a plurality of rows of discontinuous projections at edge portions of the tier sheet extending from and above an upper surface and extending from and below a lower surface of the tier sheet sufficiently to impede lateral movement of an outside container disposed at an outside row from displacing the outside container from the stack, said plurality of rows spaced a distance away from said edge portion around said perimeter of said tier sheet, wherein said plurality of rows do not extend into an interior planar section of the tier sheet.

2. The tier sheet of claim 1, wherein on an opposite surface of an edge portion from a projection there is an opposite depression in the edge portion.

3. The tier sheet of claim 2, wherein the projection and opposite depression are in the form of a score line in the surfaces.

4. The tier sheet of claim 1, wherein the edge portion has a width of at least 0.5 inch.

5. The tier sheet of claim 4, wherein the width is at least 1.0 inch.

6. The tier sheet of claim 1, wherein the tier sheet is made of a material selected from the group consisting of fiberboard, plastic, kraft board and chip board.

7. The tier sheet of claim 1, wherein the tier sheet has lateral edge dimensions of from 18 to 60 inches and a thickness of from 0.03 to 0.3 inch.

8. The tier sheet of claim 1, wherein the tier sheet contains a bactericide or an insecticide.

9. The tier sheet of claim 8, wherein the bactericide or insecticide is coated on the tier sheet.

10. A sheet for use with shipping material containers comprising:

a sheet having an upper and lower surface, each defining a plane, said sheet having a perimeter; and a plurality of rows of discontinuous projections extending from each of the upper and lower surface, each of said projections extending beyond said plane thereof, each of said plurality of rows disposed a distance from and around said perimeter wherein the plurality of rows does not extend into an interior planar section of the sheet.

11. A sheet for use with shipping multiple containers comprising:

a sheet having a width and an upper and lower surface, each surface defining a plane; and a plurality of rows of discontinuous depressions extending beyond each of the upper and lower surface, the plurality of rows extending into the width of the sheet, wherein the plurality of rows do not extend into an interior planar section of the sheet.

12. In a tier sheet for supporting a plurality of containers disposed in rows on the tier sheet and for supporting and separating a plurality of tiers of the containers to provide a tiered stack of the containers, said tier sheet having a perimeter, the improvement comprising:

a plurality of rows of discontinuous projections at edge portions of the tier sheet extending from and above an upper surface extending from and below a lower surface of the tier sheet sufficiently to impede lateral movement of an outside container disposed at an outside row from displacing the outside container from the stack, wherein the plurality of rows is spaced a distance away from said edge portion and around said perimeter of said tier sheet; and wherein the plurality of rows is multi-directional.

13. The tier sheet of claim 12, wherein the plurality of rows does not extend into an interior planar section of the tier sheet.

* * * * *

UNITED STATES PATENT AND TRADEMARK OFFICE

CERTIFICATE OF CORRECTION

PATENT NO. : 7,089,871 B2
APPLICATION NO. : 10/725861
DATED : August 15, 2006
INVENTOR(S) : Smith, Jr.

It is certified that error appears in the above-identified patent and that said Letters Patent is hereby corrected as shown below:

On the face page, in field (56), under "Foreign Patent Documents", in column 2, line 1, delete "10/1980" and insert -- 11/1980 --, therefor.

In column 5, line 62, delete "altrough" and insert -- although --, therefor.

Signed and Sealed this

Fifth Day of December, 2006

JON W. DUDAS
*Director of the United States Patent and Trademark Office*